United States Patent [19]

Scherpf

[11] Patent Number: 4,771,598

[45] Date of Patent: Sep. 20, 1988

[54] ARRANGEMENT OF THE COURSE OF THE THREAD IN A TEXTURING MACHINE

[75] Inventor: Hans-Dieter Scherpf, Hammelburg, Fed. Rep. of Germany

[73] Assignee: FAG Kugelfischer Georg Schafer (KGaA), Fed. Rep. of Germany

[21] Appl. No.: 23,477

[22] Filed: Mar. 9, 1987

[30] Foreign Application Priority Data

Mar. 29, 1986 [DE] Fed. Rep. of Germany ..... 3610614

[51] Int. Cl.[4] ..... D02G 1/02; D02G 1/08

[52] U.S. Cl. ..... 57/290; 57/284; 57/340

[58] Field of Search ..... 57/282–285, 57/290, 291, 339, 340

[56] References Cited

U.S. PATENT DOCUMENTS

| | | | |
|---|---|---|---|
| 3,192,697 | 7/1965 | Carruthers | 57/285 |
| 3,321,904 | 5/1967 | Horvath et al. | 57/285 X |
| 3,422,613 | 1/1969 | Berger, Jr. et al. | 57/285 X |
| 3,423,924 | 1/1969 | Comer et al. | 57/285 X |
| 3,445,996 | 5/1969 | Berger, Jr. | 57/285 X |
| 3,516,240 | 6/1970 | Fain | 57/285 X |
| 3,831,365 | 8/1974 | Smith | 57/285 X |
| 3,863,434 | 2/1975 | Doschko et al. | 57/285 X |
| 4,134,252 | 1/1979 | Otaki et al. | 57/284 |
| 4,581,883 | 4/1986 | Streppel | 57/284 X |
| 4,584,831 | 4/1986 | Schuster et al. | 57/339 |

FOREIGN PATENT DOCUMENTS 7522099 2/1976 Fed. Rep. of Germany .

*Primary Examiner*—John Petrakes

*Attorney, Agent, or Firm*—Ostrolenk, Faber, Gerb & Soffen

[57] ABSTRACT

In an arrangement for texturing threads used in producing yarn, the threads are preheated by passing through channels of a contact heater before passing through the known yarn texturing, e.g. false twisting units. To increase thread and yarn production with a particular contact heater, two threads are passed through a respective heating channel in the heater, rather than one thread. To accomplish this, one thread has a right hand, regular or Z-twist or turn and the other has a left hand, reverse or S-twist or turn, and their crimp causes them to avoid each other at opposite sides of the channel, and not to undesirably contact. A respective texturing unit is supplied for each of the threads that has been heated.

13 Claims, 4 Drawing Sheets

ARRANGEMENT OF THE COURSE OF THE THREAD IN A TEXTURING MACHINE

BACKGROUND OF THE INVENTION

The invention concerns arrangement of the course of the thread in a texturing machine for plied yarns. The threads and resulting yarn are usually at least partially of a plastic material, which may be extruded or spun from a mass. Such texturing machines have a plurality of units for texturing yarn. Each such unit typically requires a respective heating passage in which the thread is heated before it is textured. An increase in the number of texturing arrangements requires a corresponding increase in the number of heating passages. The heater is usually a contact heater with a respective channel defining a heating passage for each thread, and the thread is heated by contact with a wall of the channel.

U.S. Pat. No. 4,584,831 describes a device for the false twisting of threads which makes it possible for two complete texturing units to be arranged in a very narrow space on only one support. The device is particularly suitable for the conversion of existing texturing machines on which doubled yarns and particularly with a right hand or regular twist or turn (in Germany referred to as a Z-twist) and with a left hand or reverse twist or turn (in Germany referred to as an S-twist) are to be worked together. These machines are usually equipped with heaters which are designed for a particular number of fiber texturing places. For instance, if there are 192 texturing places, only 192 heating channels are present. For doubling of yarn production by use of the above-mentioned two unit false twisting arrangements, a new heater is required in the normal case in order to be able to texture the threads unimpeded.

German Utility Model No. 75 22 099 describes a thread guide which is arranged above the heater. The guide is intended to prevent the threads from contacting each other within the heater. Such contact would form closed places, so-called "tight spots." Separating the two threads only at the outlet of the heater by means of the thread guide does not prevent the threads from striking against each other within the heating channel, since neither the direction of travel of the thread nor the direction of twist of the thread is taken into account. The danger of "tight spots" and of thread breakage is still present.

SUMMARY OF THE INVENTION

The object of the invention is to eliminate the disadvantages pointed out above. Another object, therefore, is to be able to increase, and particularly double, the number of threads which can be textured in any particular texturing machine.

A further object of the invention is to increase the number of threads that can be textured in a texturing machine having a particular heater for preheating the threads before they are exposed to the texturing units. For example, in an existing machine there may be a heater having as many as 192 heating channels. Typically, each channel would prepare a single thread to be textured by one texturing unit. Desirably, using the texturing units according to U.S. Pat. No. 4,584,831, the number of texturing units to be served by a particular heating channel may be doubled, i.e. when there are 192 heating channels, they could supply threads for 384 texturing units, resulting in a considerable increase in yarn production with a particular heater.

The invention permits the false twisting unit described in U.S. Pat. No. 4,584,831 to convert an existing machine so that its production can be doubled while still using the heaters that were already present for the original production level and without any further changes.

The invention is used in a texturing machine for plied yarns having a heater, and particularly a contact heater, with a number of pathways for preheating fibers to be textured, and particularly having heating channels. Instead of providing a single texturing unit for each heating channel, for at least some and more likely all of the heating channels, two fiber texturing units, e.g. false twisting units, are provided. The two texturing units are supplied with fiber from the respective single heating channel. The heater with its heating channels is upstream in the path of thread travel from the thread texturing units.

The invention contemplates that each heating channel be supplied with one each of threads of different twists which are adapted to prevent the threads from undesirably contacting or banging into one another as they move through the heating channels. In particular, one of the threads has a left hand, reverse or S-twist or turn, and may be called an S thread and the other thread has a right or regular twist or turn, and may be called a Z thread. The two threads of reversed twists travel through one heating channel. Threads with those respective S and Z twists typically deflect in opposite directions from one another, while they are inside and especially as they leave the heating channel, which assures that the two different twist threads do not contact. In particular, when the thread pathway is through a heating channel from the inlet at the top to the outlet at the bottom, looking into heating the channel from the side, from the outside of the heater, the S thread is arranged on the left and the Z thread is on the right in the channel. An arrangement is also known, as in DE-OS No. 2 450 327, where the heater is disposed below the texturing units so that the threads move from the inlet at the bottom of the heater to the outlet at the top of the heater and then into the texturing units. In that case, looking into the channel from the side, from the outside of the heater, the S thread is arranged on the right in the channel and the Z thread is arranged on the left.

Along the course of travel of the threads, for instance, from the top to the bottom, which is illustrated below, the threads are so arranged that the S thread with the left hand twist travels on the left and the Z thread with the right hand twist travels on the right, as seen from the operation side. As a result of the specific twist imparted to an S and a Z thread, each thread always turns away from the other out of the bottom or the base of the heater channel. As a result, the threads cannot contact each other although they travel only in a single heating channel. Upon the reverse, i.e. upward travel of the threads, the threads are also arranged in a corresponding manner.

There is a four-groove transfer roller for fixing the travel of the threads disposed just before the heating channel inlets. Previously, two heating channels were disposed near one another to act in cooperation, each having one of the threads moving through it. In the invention, since two threads can move through each channel, when two channels are near one another, the four-groove transfer roller establishes the spacing and direction of the threads entering the two heating channels. There is another corresponding transfer roller at the exit of the heating channel which directs the threads to the respective texturing units, one texturing unit for each thread.

In addition to the great financial advantage of doubling the yarn production, there is the further advantage that, due to the fact that the threads travel without contacting each other within the heater channel, there are neither tight spots nor thread breaks. By this arrangement, therefore, precise travel of the threads is insured.

Other objects and features of the invention are explained with reference to the drawings showing a preferred embodiment.

DESCRIPTION OF THE PRIOR ART

Figure 1:
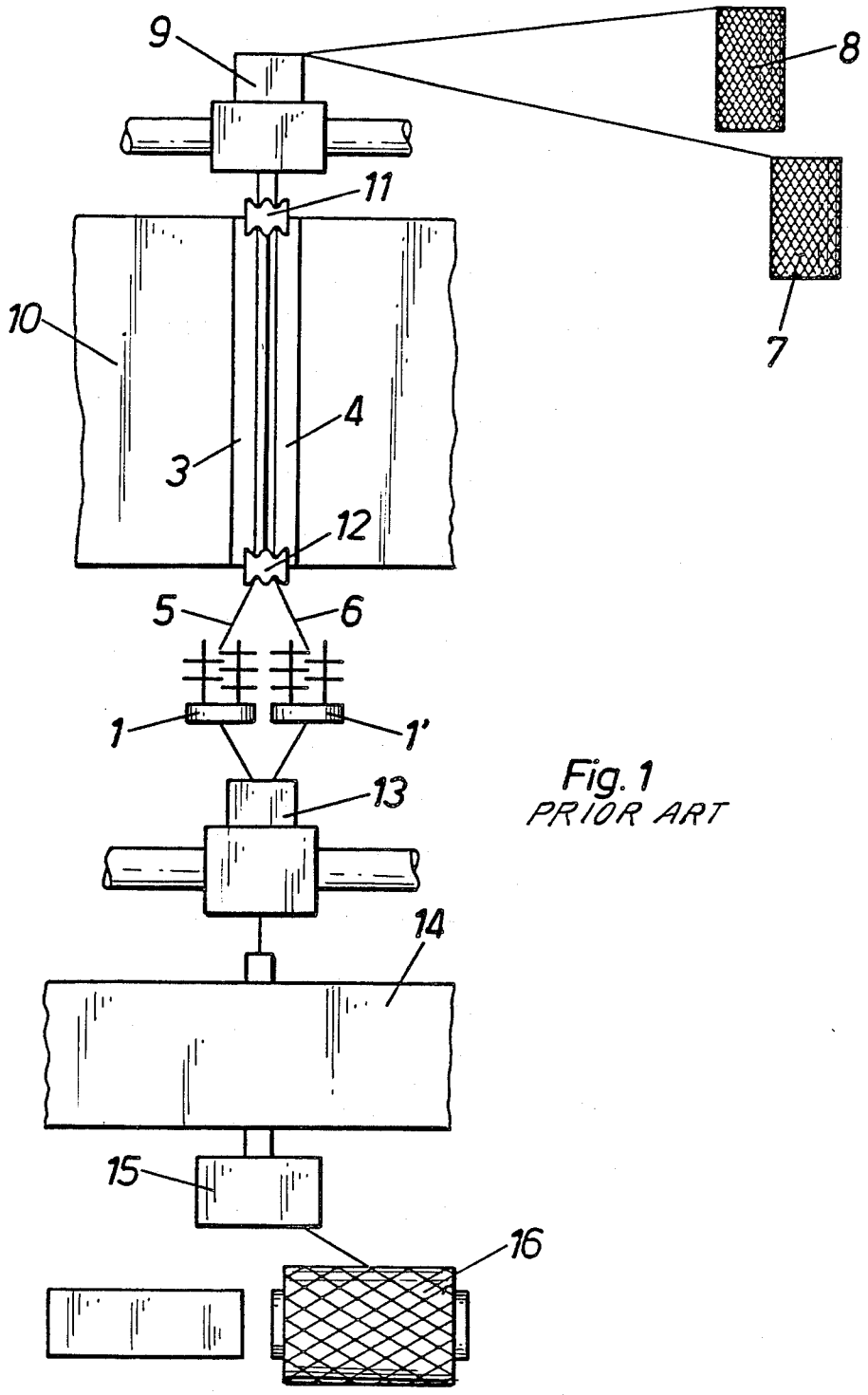
Fig. 1 PRIOR ART
FIG. 1 shows part of a prior art machine with two individual texturing, false twist units being served by two heating channels.

FIG. 1 shows a prior art texturing machine having two individual false twisting units 1 and 1'. Each unit is served by a respective one of the two heater channels 3 and 4 provided in a contact heater 10 above the false twisting units. The threads 5 and 6 are conducted from their respective bobbins 7 and 8, over the feeder 9, pass through the heater 10 having the channels 3 and 4, then pass the two-groove thread guide elements 11 and 12 and pass through the individual false twisting units 1 and 1' and to the feeder 13. The threads pass through the false twist setting heater 14 via the feeder 15 and to the take-up bobbin 16.

DESCRIPTION OF A PREFERRED EMBODIMENT

Figure 2:
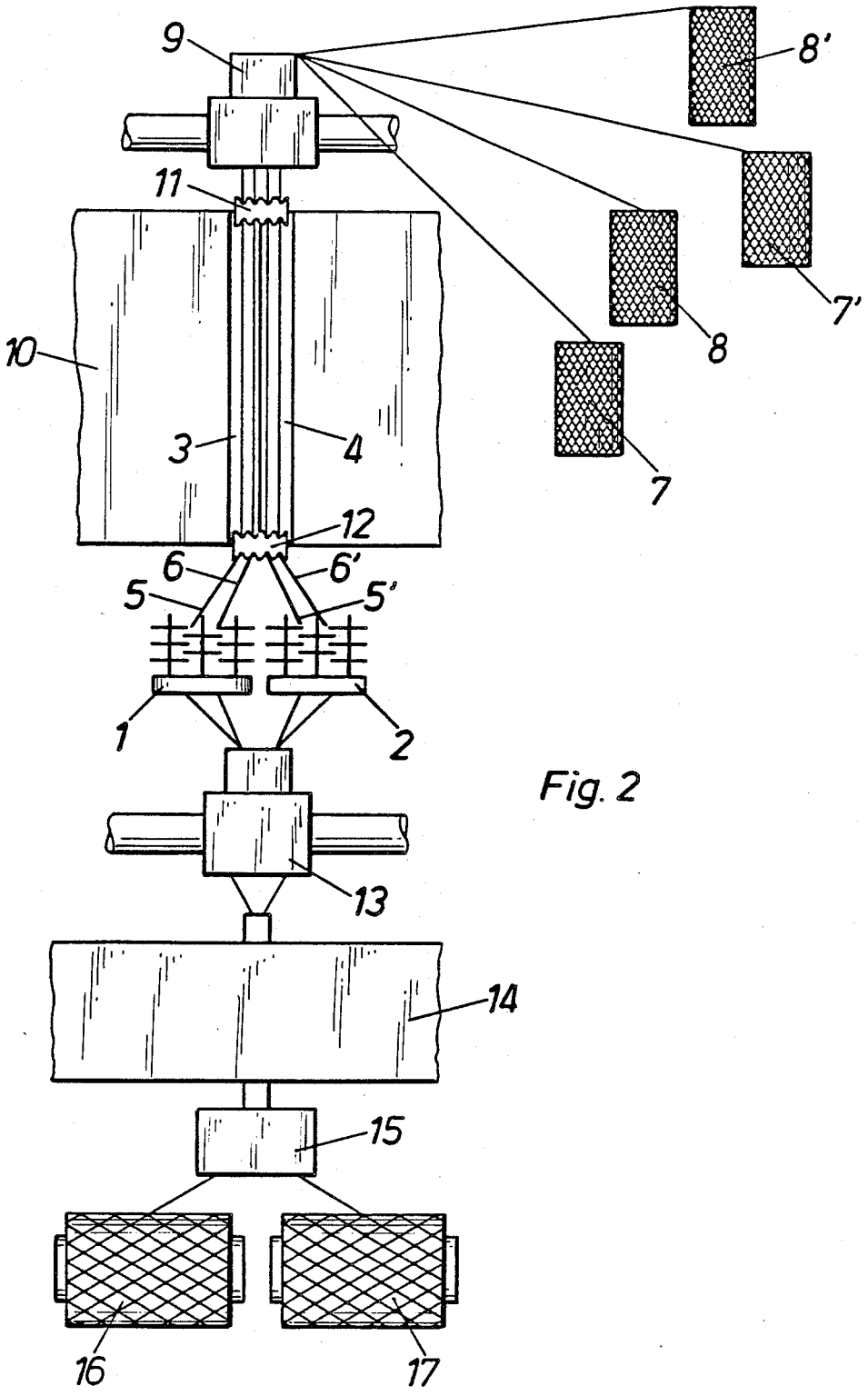
FIG. 2 shows the same part of a machine with four texturing, false twist units, with the arrangement of thread travel in accordance with the invention, i.e. doubled production with two heating channels.

FIG. 2 shows the arrangement of the courses of the threads in accordance with the invention. The heater 10 and its channels 3 and 4 may remain the same. The yarn production is doubled. From the bobbins 7 and 7' the threads 5 and 5' having a left hand, reverse of S-twist, or turn, and from the bobbins 8 and 8' the threads 6 and 6' having a right hand, regular of Z-twist or turn together are fed via the feeder 9 past the now four-groove 9uide roller 11, for the four threads, into the two heater channels 3 and 4. The threads 5 and 6 occupy one channel 3 and the threads 5' and 6' occupy the second channel 4. Via the four-groove thread guide roller 12, the threads are then guided into the two double false twist units 1 and 2 of the type in the above U.S. Pat. No. 4,584,831. The unit for the right hand twist thread has consecutive friction surfaces that rotate in the sense of a left hand screw. The unit for the left hand twist has consecutive surfaces that rotate in the sense of a right hand screw. Then, the threads pass via the feeder 13 through the set heater 14, to the feeder 15, and are wound up on the take-up bobbins 16 and 17. In this case, the threads 5 and 6, on the one hand, and the threads 5' and 6', on the other hand, respectively form a plied yarn.

Figure 3:
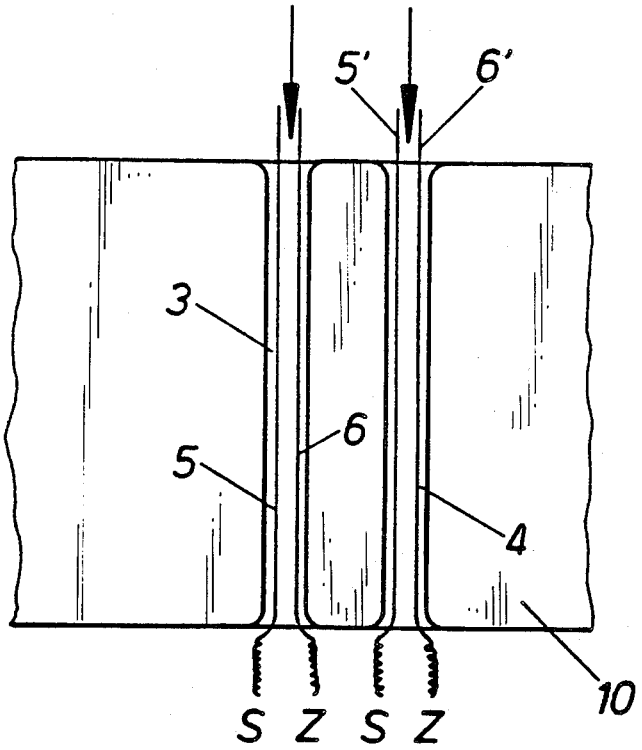
FIG. 3 is a front elevational view of a fragment of a heater showing the thread travel within two heater channels and showing the S and Z threads.

FIG. 3 shows a portion of the heater 10 looking at the channels 3 and 4, and seen in front view. The threads 5 and 5' with their left hand or reverse S-twist or turn and 6 and 6' with their right hand or regular Z-twit or turn clearly show the courses of their crimping. Their respective twists cause them to follow along opposite edges of their channels, with the result that the threads do not touch each other.

Figure 4:
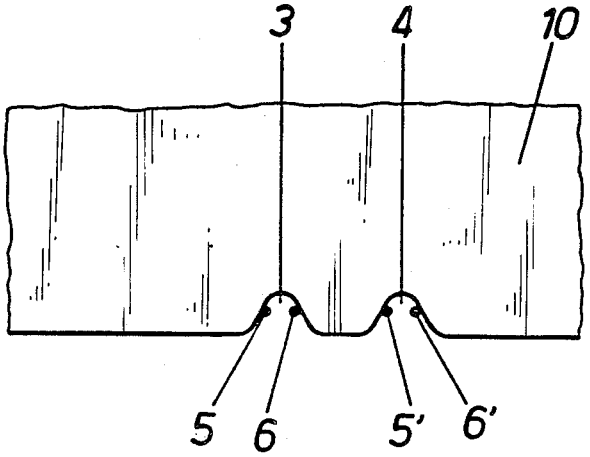
FIG. 4 is a top view of the heater showing the thread positions within the heater channel.

In FIG. 4 the heater 10 is shown in top view, showing the positioning of the threads 5, 6, 5' and 6' in their heating channels 3 and 4.

Figure 5:
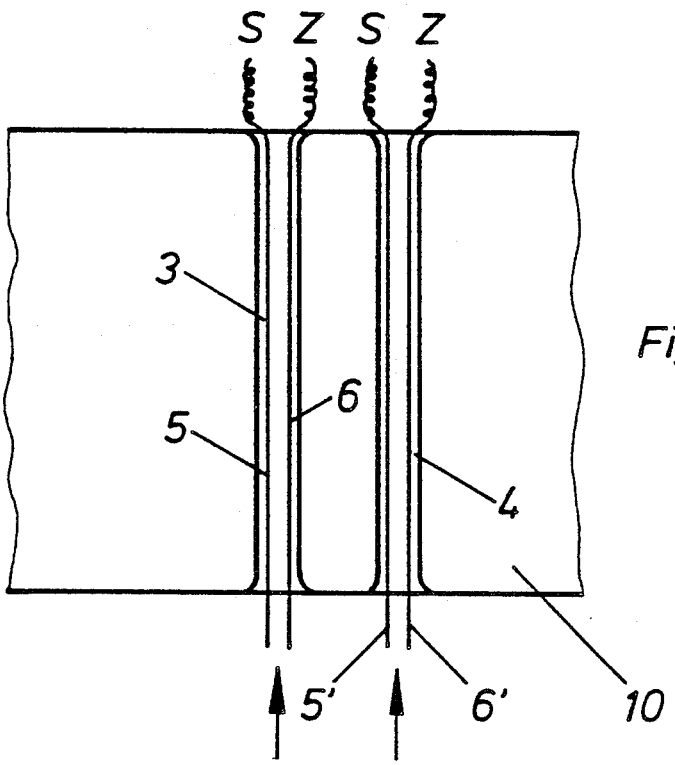
FIG. 5 is a front elevational view of a fragment of the heater showing the thread travel between the two heating channels and showing the S and Z threads, wherein the threads travel upwardly through the heating channels.

FIG. 5 is similar to FIG. 3 and provides a front elevational view of a segment of the heater. It shows the S and Z threads travelling between the two heating channels. The threads travel upwardly through the heating channels.

Although the present invention has been described in connection with a preferred embodiment thereof, many variations will now become apparent to those skilled in the art. It is preferred, therefore, that the present invention be limited not by the specific disclosure herein, but only by the appended claims.

What is claimed is:

1. An arrangement for the texturing of threads for yarn comprising first means for supplying a first thread with a left hand, reverse, S-twist; second means for supplying a second thread with an opposed, right hand, regular Z-twist; a heater having a heater channel therethrough and the channel having an inlet and an outlet; means for directing both the first thread and the second thread from the respective first and second means into the inlet to the channel, the opposed twists of the first and second threads being effective to maintain the threads separated from one another in the heater channel; means beyond the outlet from the channel for redirecting each of the first and the second threads; a respective thread texturing unit for each of the first and the second threads and the redirecting means redirecting the first thread to a first one of the texturing units and the second thread to a second one of the texturing units for texturing the threads.

2. The arrangement of claim 1, further comprising the heater having two of the heater channels; two of the first supply means, each for supplying a first thread, two of the second means, each for supplying a second thread, first guiding means for guiding a first one of the first and second threads to the first of the two channels and second guiding means for guiding a second one of the first and second threads to the second channel.

3. The arrangement of claim 2, wherein there is a respective one of the thread texturing units for each of the first and second threads, and the redirecting means directs each thread to its respective texturing unit.

4. The arrangement of claim 2, wherein the threads are directed to their respective heater channels and the channels are arranged so that each channel inlet is at the top of the heater and each channel outlet is at the bottom of the heater, so that the first thread moves on the left side of the channel looking into the channel from the side, and the second thread moves on the right of the channel, looking into the channel from the side.

5. The arrangement of claim 2, wherein the first and second guiding means comprise a single guiding means for directing the first and second threads to the respective ones of the first and second channels.

6. The arrangement of claim 5, wherein the single guiding means for directing the threads to their respective channels comprises a transfer roller having a respective groove for each of the threads so that the roller directs the threads to the first and second channels.

7. The arrangement of claim 2, further comprising means beyond the respective texturing units for receiving the threads textured by the texturing units.

8. The arrangement of claim 7, wherein the means for receiving the threads comprises means for heating the threads following their texturing to set the threads and then thereafter means for receiving the set threads.

9. The arrangement of claim 2, wherein the heating channel is arranged so that the inlets to the heating channels are at the bottom of the heater and the outlets from the heating channels are at the top of the heater, the threads being guided into the respective channels so that looking into the channels from the side, the first thread is on the right of the channel and the second thread is on the left of the channel moving from the inlet to the outlet of the channel.

10. A method for texturing threads for yarn comprising:

imparting a left hand, reverse, S-twist to a first thread and imparting an opposed, right hand, regular Z-twist to a second thread;

passing the first thread and the second thread from the inlet to the outlet of a heater channel of a thread heater, the opposed twists of the first and second threads being effective to maintain the threads separated from one another in the heater channel;

heating the heater channel; and texturing the threads exiting the channel outlet.

11. The method of claim 10, comprising passing the threads in a downward direction through the channel from the inlet to the outlet thereof.

12. The method of claim 10, comprising passing the threads through the channel such that the threads pass in an upward direction through the channel.

13. The method of claim 10, further comprising receiving the threads after they have been textured.

* * * * *